United States Patent [19]

Ensley et al.

[11] 4,231,835

[45] Nov. 4, 1980

[54] APPARATUS FOR AND METHOD OF MAKING CARPETING STRIP HAVING INTEGRAL SEAM-FORMING PORTION

[75] Inventors: Rufus N. Ensley, Waynesville; Doyle V. Haren, Clyde; Arthur D. Logan; Michael E. McLean, both of Waynesville, all of N.C.

[73] Assignee: Dayco Corporation, Dayton, Ohio

[21] Appl. No.: 28,787

[22] Filed: Apr. 10, 1979

[51] Int. Cl.[3] ..... B65H 25/00; B32B 31/00

[52] U.S. Cl. ..... 156/361; 156/378; 156/494; 156/496; 156/516; 156/522; 156/538

[58] Field of Search ..... 428/62, 40; 156/494, 156/496, 516, 522, 350, 351, 361, 352, 378, 538; 271/226; 264/291

[56] References Cited

U.S. PATENT DOCUMENTS

| | | | |
|---|---|---|---|
| 1,137,243 | 4/1915 | Terry | 156/496 |
| 3,150,024 | 9/1964 | Penman | 156/496 |
| 3,576,696 | 4/1971 | Normanton | 156/496 |
| 4,089,728 | 5/1978 | Teed | 156/352 |
| 4,092,450 | 5/1978 | Haren | 428/45 |

*Primary Examiner*—Paul J. Thibodeau

*Attorney, Agent, or Firm*—Reuben Wolk; Charles E. Bricker

[57] ABSTRACT

An apparatus for and method of making a carpeting strip are provided wherein such carpeting strip has integral joining means enabling the forming of a substantially invisible seam between an adjoining pair of carpeting strips upon forming a carpet employing such strips.

16 Claims, 17 Drawing Figures

APPARATUS FOR AND METHOD OF MAKING CARPETING STRIP HAVING INTEGRAL SEAM-FORMING PORTION

BACKGROUND OF THE INVENTION

1. Field of the Invention

This invention relates to carpeting strips each comprised of a wear layer bonded against a compressible resilient backing material and having integral means enabling a plurality of such carpeting strips to be joined with a substantially invisible seam therebetween; and in particular to an apparatus for and method of making such carpeting strips employing release tape on such carpeting strips to enable provision of such an invisible seam.

2. Prior Art Statement

It is known in the art to provide carpeting strips of the character mentioned and as disclosed in U.S. Pat. No. 4,092,450. However, to provide a commercially competitive carpeting strip of the character disclosed in this patent it is necessary that such strip be produced in a continuous manner with minimum scrap and with optimum utilization of production devices and techniques which assure continuous uninterrupted production.

SUMMARY

It is a feature of this invention to provide an apparatus for continuously producing carpeting strip having a wear layer, a compressible backing material, and a release tape fixed to the wear layer along at least one side portion of the strip with the tape serving to isolate from the wear layer a width portion of the backing material corresponding to the width of the tape and wherein such tape enables a plurality of carpeting strips to be joined by a non-professional carpet installer to define an overall carpet having a substantially invisible seam between joined carpeting strips.

Another feature of this invention is to provide an apparatus of the character mentioned for producing such carpeting strip having release tape of the character mentioned along opposite side portions thereof.

Another feature of this invention is to provide an apparatus of the character mentioned having cooperating release tape bonding apparatus, carpeting strip trimming apparatus, and release tape detection apparatus.

Another feature of this invention is to provide an apparatus of the character mentioned which employs a precisely controlled tenter assembly as part of its means for moving the wear layer and overall carpeting strip during forming or manufacture thereof in a continuous manner.

Another feature of this invention is to provide an apparatus of the character mentioned wherein the trimming apparatus is operated independently of the tenter assembly.

Another feature of this invention is to provide an apparatus of the character mentioned wherein the trimming apparatus has a pair of cutters for cutting through the wear layer, release tapes, and backing material and a mechanism for positioning each of the cutters to define the width of the carpeting strip and assure that a predetermined required width of each release tape remains on the carpeting strip after cutting by its cutter. With each cutter providing a precision planar factory cut side edge for the carpeting strip defined by an edge of the wear layer, associated release tape, and backing material disposed in coplanar relation.

Another feature of this invention is to provide a method of making a carpeting strip of the character mentioned.

Therefore, it is an object of this invention to provide an improved apparatus and method of having one or more of the features set forth above or hereinafter shown or described.

Other details, features, uses, objects, and advantages of this invention will become apparent from the embodiments thereof presented in the following specifications, claims, and drawings.

BRIEF DESCRIPTION OF THE DRAWINGS

The accompanying drawings show present preferred embodiments of this invention, in which.

DESCRIPTION OF EXEMPLARY CARPETING STRIP AND CARPET MADE USING APPARATUS AND METHOD OF THIS INVENTION

An exemplary carpeting strip of the type disclosed herein is presented in the previously mentioned U.S. Pat. No. 4,092,450, and the disclosure of this patent is incorporated herein by reference thereto. However, in order to produce such a carpeting strip economically and with sufficient manufacturing precision to enable a typical non-professional carpet installer to install such carpeting strip and still provide a professional quality installation the improved apparatus and method illustrated in FIGS. 1A and 1B are preferably employed.

Figures 1A, 1B, 2, 2A:
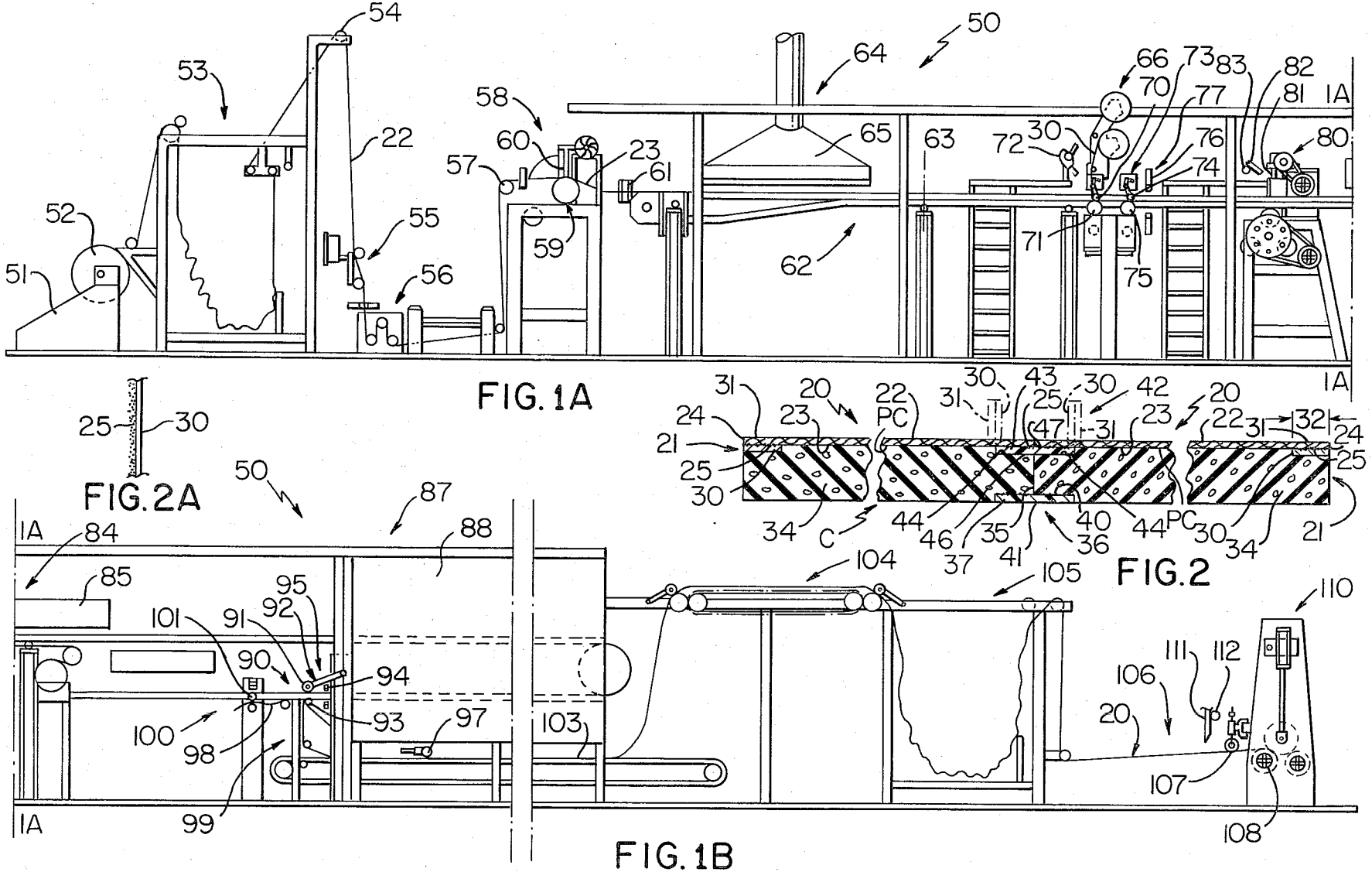
FIGS. 1A and 1B present a view in elevation of an apparatus and method of this invention with FIG. 1B being an extension of FIG. 1A upon superimposing the line 1A—1A of FIG. 1B on the line 1A—1A of FIG. 1A, and wherein such apparatus and method are employed in making a carpeting strip having integral joining means for forming a substantially invisible seam or joint between an adjoining pair of carpeting strips.
FIG. 2 is a view, not drawn to scale, with parts in cross-section and parts broken away illustrating a pair of carpeting strips, made by the apparatus and method of FIGS. 1A and 1B, joined together and having a high strength substantially invisible joint therebetween.
FIG. 2A is an enlarged fragmentary side view particularly showing adhesive material on release tape comprising the carpeting strips of FIG. 2.

Reference is now made to FIG. 2 of the drawing which illustrates two portions of identical carpeting strips 20 (with their center portions broken away) made employing the apparatus and method of FIGS. 1A and 1B and with associated side edges in adjoining relation to define an overall carpet designated generally by the reference letter C. Each carpeting strip 20 has integral means on opposite side edges thereof and each designated generally by the reference numeral 21 for defining a substantially invisible seam between strip 20 and a substantially identical strip. Each carpeting strip 20 comprises a wear layer 22 having a bottom or inside surface 23 and such wear layer has opposed side edges each designated by the same reference numeral 24. An adhesive material in the form of a strip-like band or coating 25 is provided on the bottom surface 23 adjacent each side portion of the strip 20 and such coating is indicated by stipling in the form of spaced dots. The adhesive 25 may be in the form of adhesive material applied directly against the bottom surface 23 and protected with release tape which is free of adhesive, a comparatively thin so-called double-adhesive back tape protected on its surface away from surface 23 with release tape, adhesive material initially provided as a layer on a release tape and which remains adhered to the surface 23 upon removal of the release tape, or any suitable similar material whereby such release tape is designated by the reference numeral 30. The release tape 30 at each side portion of strip 20 enables the carpeting strip to be manufactured while defining a free part 31 of the wear layer 22 along its length and such free part 31 has a width 32 defined by the width of release tape 30 associated therewith.

The release tape 30 of this example of the invention has one surface thereof provided with a meltable adhesive 25 thereon (FIG. 2A) and such adhesive is disposed against the inside surface 23 of the wear layer 22 and serves to hold the tape 30 firmly in position. The meltable adhesive 25 on the release tape 30 is activated by heating thereof so that it will adhere to the inside surface of the wear layer 22 and such adhesive 25 remains on the wear layer 22 once the tape 30 is removed whereupon the adhesive 25 is then used in joining carpeting strips 20 to define the carpet C as will be described in more detail subsequently.

The carpeting strip 20 has a compressible polymeric sponge-like or foam-like backing material 34 bonded against its wear layer 22 and in particular, against surface 23 of such wear layer except at locations covered by the release tape. The release tape 30 at each side of strip 20 is, in essence, a dual-purpose tape which serves to isolate and maintain adhesive 25 ready for use by providing a freshly exposed adhesive surface upon exposing such adhesive 25 by removal of the tape 30 as well as isolating a width portion of the compressible backing material 34 from the wear layer 22 upon integrally forming the backing material 34 against the tape 30. Each tape 30 defines the above-mentioned free part 31 of the wear layer 22 for a purpose now to be described.

In particular, to install a pair of carpeting strips 20 in adjoining relation to define a carpet C as illustrated in FIG. 2, a pair of carpeting strips 20 are placed with associated edges 35 in abutting relation as shown at 36 in FIG. 2. If desired, a suitable so-called double-adhesive-back tape 37 may be used to fasten the bottom surfaces of the backing material 34 immediately adjacent edges 35 against an associated supporting floor (not shown) by adhering one surface 40 of the tape 37 to the compressible backing material 34 and the other surface 41 of such tape to such supporting floor, or the like. The tape 37 also serves to hold the edges 35 against movement during the seaming operation whereby the edges 35 are fastened together so as to define a substantially invisible seam therebetween as will now be described.

In particular, the free portions 31 of the wear layers 22 of carpeting strips 20 with their release tapes 30 adhered are lifted substantially vertically as indicated by dotted lines at 42 in FIG. 2. With the free portions 31 thus lifted, suitable support means 43 (of any type known in the art) is bonded against what will be referred to as isolated portions 44 of the backing material 34. The isolated portions 44 referred to are defined by associated release tapes 30. The support means 43 in this example comprises double-adhesive-back-tape with the bottom surface 46 of tape 43 being bonded against the isolated portions 44. At this point, the release tape 30 is removed from one of the carpeting strips 20 to provide freshly exposed adhesive 25 whereupon the free portion 31 is adhered against the top adhesive surface 47 of the tape 43. A similar procedure is followed with the free portion 31 of the wear layer 22 of the other carpeting strip 20 whereby the top surfaces of the free parts 31 are disposed in substantially coplanar relation while defining a substantially invisible junction or seam between adjoining side edges of the carpeting strips 20.

It will be appreciated that this entire operation of joining side edges of a pair of carpeting strips 20 may be achieved without requiring special tools and while employing precision factory cut edges to define a substantially invisible seam between carpeting strips. It will also be appreciated that instead of tape 43 any other suitable support means known in the art may be used to bridge between and join side edge portions of a pair of carpeting strips 20.

DESCRIPTION OF THE OVERALL APPARATUS AND METHOD FOR CONTINUOUSLY PRODUCING A CARPETING STRIP

Having described the carpeting strip 20 and a typical carpet C defined using a pair of such strips, the detailed description will now proceed with an apparatus and method which may be used to make such a carpeting strip and such apparatus and method is illustrated in FIGS. 1A and 1B and designated generally by the reference numeral 50. The apparatus 50 comprises a so-called let-off device 51 which supports a supply roll 52 of a suitable wear layer defining material which is preferably in the form of a fabric and such fabric wear layer will be designated by the same reference numeral 22 as in the completed carpeting strip 20. The supply roll 50 is supported by device 51 for controlled unwinding rotation and the fabric wear layer 22 is fed through a so-called J-box fabric accumulator assembly 53 which may be of any suitable type known in the art and for purposes known in the art.

The fabric wear layer 22 is moved around a turn roll 54 and fed vertically downwardly through a floating roll steering guide assembly 55 which serves to align such wear layer for subsequent operations. The wear layer 22 is then moved through an adjustable fabric tension control assembly 56 which in this example is in the form of a three roll assembly. The assembly 56 provides a controlled constant tension on the wear layer enabling processing thereof in a continuous manner.

The tensioned wear layer 22 is continued over an expander roll 57 which may be a bowed roll which spreads or opens up spaces between yarns or filaments of the fabric for coating purposes. The wear layer then continues to a precoat station 58 of the apparatus 50. At station 58 a so-called knife over roll coater 59 having a suitable knife or doctor blade 60 associated therewith is used to apply a suitable polymeric precoat PC (FIG. 2) between release tapes 30 on the inside surface 23 of the wear layer 22. The precoat PC seals the interstices in the wear layer 22, promotes adhesion of polymeric material defining the backing material 34 to be coated thereagainst, and controls the feel or hand of the wear layer 22.

As the wear layer 22 exits the precoating station 58 and continues through the apparatus 50, photoelectric detector devices 61 are provided and sense opposite side edges thereof and provide appropriate signals which are used to make adjustments in the apparatus 50 which assure precision guiding of the opposed fabric edges into the fabric stretching or swing section of a tenter assembly 62. The opposed edge portions of the fabric wear layer 22 are attached to tenter pins, not shown, by urging the fabric so that such pins extend therethrough.

The tenter assembly 62 serves to initially gradually stretch the wear layer in its swing section to a predetermined precise width shown basically at location 63 which commences what will be referred to as a constant width section of the tenter assembly. During the time that the wear layer 22 is placed on the tenter pins and stretched to a constant width the precoat applied at the precoat station 58 is dried at a precoat drying station 64 by a heater 65 which may be of any suitable type and in this example is in the form of an electrical infrared heater.

The wear layer 22 then continues to a taping station 66 where release tape 30 is applied to the inside or normally concealed surface 23 (concealed in the completed carpeting strip 20) of the wear layer at spaced apart locations on opposite side portions of such wear layer employing a pair of taping devices each at an associated side portion of the wear layer 22 with each taping device having a tape-applying roller 70. During application of each release tape 30 the tape is supported by backup means in the form of a backup roll 71 associated with each tape applying roller 70. As indicated earlier, the release tape 30 is of the type which has adhesive 25 thereon and such adhesive is heat activated immediately prior to application of the tape 30 against the wear layer 22. In this example the heat activation is provided by a hot air blower 72 associated with each tape 30 and the blower 72 has a hot air discharge nozzle. The adhesive 25 remains on the inside surface 23 of the wear layer 22 after removal of the tape 30 as previously mentioned.

The apparatus and method 50 employ a tape bonding station 73 where a pressure roller 74 is employed in cooperation with a backup roller 75. The action of the rollers 74–75 at station 73 assures that the tape 30 applied at the taping station 66 is urged more tightly against the inside surface 23 of the wear layer 22 whereby the final carpeting strip 20 is assured of having the required release tape 30.

The apparatus and method 50 also employ a photoelectric device 76 in association with each tape 30 at uncovered release tape detection station 77 to detect the presence of such tape at each side portion of the wear layer 22. In the event tape 30 is not present on either side portion of such wear layer 22, for any reason, a suitable alarm or signal is provided to indicate the absence of release tape 30 and thereby allow appropriate corrective action to be taken.

The wear layer 22 with release tape 30 adhered to its opposite side portions is then introduced through a backing cushion applying station or foam applying station 80 where a suitable thickness of compressible yet resilient backing material is applied thereon and such material may be in the form of sponge-like rubber, or any suitable latex foam and preferably is in the form of a no-gel foam, i.e., such foam being free of added chemical gelling agents. The backing material 34 is shown in its completed and cured condition in the final carpet C in FIG. 2.

In one exemplary embodiment of a carpeting strip 20 the latex foam cushion 34 was made utilizing a rubber foam latex such as styrene-butadiene rubber. Foam latex is applied at station 80 preferably employing a doctor blade or knife to control the thickness of the foam. In this example a doctor blade 81 is used in spaced relation above wear layer 22 and foam defining the foam cushion 34 is conveyed through a nozzle 82 which is reciprocated across the width of the wear layer 22 and cooperates with the doctor blade 81 to provide a controlled height of the latex foam. Suitable means indicated schematically by a circle 83 may be provided for moving the nozzle 82 in a reciprocating manner across the wear layer and such means 83 may be provided with suitable automatic or semi-automatic controls.

The foam material defining the latex foam cushion 34 is suitably gelled on wear layer 22 at a foam gelling station 84 employing a heating apparatus which in this example is in the form of an oven or lamp assembly 85, FIG. 1B, as it exits the foam applying station 80. The gelling apparatus 85 of this example consists of a plurality of electric heat lamps which serve to stabilize the latex foam cushion for further processing.

The carpet construction defined by wear layer 22 with release tape 30 extending along opposite side edge portions thereof and with the latex foam cushion bonded thereagainst, thereby concealing the tapes 30, is then passed through a drying and curing station 87 for drying and curing purposes. At station 87 an oven 88 of any suitable type known in the art may be employed and may comprise gas fired heaters, electric heaters, or other suitable heating means. The carpet construction of this example makes a plurality of passes through the oven 88 to complete the drying and curing thereof.

The dreid and cured carpeting strip 20 with tape 30 along its opposite side portions is introduced into a carpeting strip trimming station 90 immediately after inspection for the presence of covered or concealed release tape 30 as will be described subsequently. At the trimming station 90 a pair of rotary slitters or cutters 91 comprising a cutting apparatus 92 are used to the carpeting strip and define a corresponding pair of trimmed strips or ribbons of scrap material which are removed from the apparatus 50 in a manner to be described subsequently. The cutters 91 associating with the two release tapes are precisely controlled and the width of the tapes is such that splitting is achieved so as to define a completed carpeting strip 20 having a precision width while still defining cut tape edges along the full length of the carpeting strip.

The rotary cutters 91 are suitably supported on the cutting apparatus 92 to assure that the carpeting strip 20 is of a precision width and further assure that the width of each release tape 30 remaining with the carpeting strip 20 is sufficient to enable joining of two strips 20 in the manner previously described. Usually three-quarters of an inch of release tape along each side strip 20 is sufficient to define a high strength joint. The cutting apparatus 92 at the cutting station 90 includes a pair of backup rollers 93 each associated with a rotary cutter 91.

The apparatus 50 has a covered or concealed release tape detection station 95 upstream of the trimming station as mentioned earlier where a pair of photoelectric devices 94 are provided and each operatively associates with a cutter 91 enabling the rotary cutters 91 to be adjusted and set for cutting purposes to provide the required width of release tape as well as define the carpeting strip 20 having edges 35 which are factory cut precision edges. The photoelectric device 94 also operatively associates with a marking mechanism 97 comprising the apparatus 50 which operates to continuously mark the foam backing layer 34 with the manufacturers identifying data and or advertising as long as the apparatus 50 is operating satisfactorily. However, if the release tape 30 associated with a particular photoelectric device 94 is either of insufficient width or not present the marking mechanism is suitably automatically operated to cease its marking action. This procedure allows inspection downstream of the mechanism, visually or by other means, whereby a length of carpeting strip, which is defective because it does not have the required width of release tape at each side portion thereof or such tape is not present, may be cut away.

After trimming or cutting the carpeting strip at cutting station 90 a pair of scrap strips or ribbons 98 of trimmed material remain on the tenter pins. The ribbons 98 are coveyed to a trim removal station 100 which employs a trim removal apparatus 101 which operates with associated apparatus to pull the strips 98 from the tenter pins of the tenter assembly whereupon the pulled strips are scrapped.

The trimmed carpeting strip 20 with the correct width of release tape 30 fixed to its opposite side portions is then conveyed vertically downwardly from the backup rollers 93 as shown at 99 and then horizontally beneath the oven 88 as shown at 103 for cooling purposes. The completed carpeting strip is then moved upwardly and over a horizontal section 104 and fed through a conventional J-box accumulator 105 for build up of a quantity of carpeting strip 20 for windup purposes.

The carpeting strip 20 is inspected at an inspection station 106 and predetermined lengths thereof are measured by a length gage 107 and suitably wound to define a supply roll 108 of carpeting strip 20 at a windup station 110. A cutting device indicated schematically by a fragmentary cutting blade 111 is employed to cut the strip 20 across its width once a predetermined length thereof has been wound to define a roll 108. The blade 111 may be reciprocated across the apparatus 50 by a suitable device 112 which is indicated schematically by a circle.

Suitable edge sensing means is provided at station 110 to assure windup of roll 108 in a smooth manner. After windup, the completed roll of carpeting strip 20 is then suitably packaged, either in a carton or wrapped in a protective covering such as a protective plastic film and removed from the windup station 110 employing suitable mechanism such as a fork lift truck, or the like, for storage and/or shipment.

The release tape 30 used in the carpeting strip may be made of paper, plastic or other polymeric material, or any suitable material which is capable of having adhesive material 25 provided thereon and which is capable of being bonded to the inside surface 23 of the wear layer 22. Further, the construction of the release tape 30 is such that once it is removed from its carpeting strip to install same to define a carpet C, the adhesive material 25 originally protected by the tape, remains on the layer 22 and being freshly exposed provides maximum adhesive capabilities.

It will also be appreciated that other apparatus and techniques may be used in the apparatus 50. For example, a bed plate or similar support structure may be used instead of a support roll at the foam applying station 80. In addition, other means such as mechanical height measurement means may be employed at the uncovered release tape detection station 77 to measure the presence of release tape immediately after application thereof instead of using photoelectric devices. In addition, it will also be appreciated that instead of rotary knives at the trimming station 90 other slitting methods and apparatus may be employed, such as, laser devices, water jets, shear cut knives, score cut knives, and the like.

THE TENTER ASSEMBLY

Figure 3:
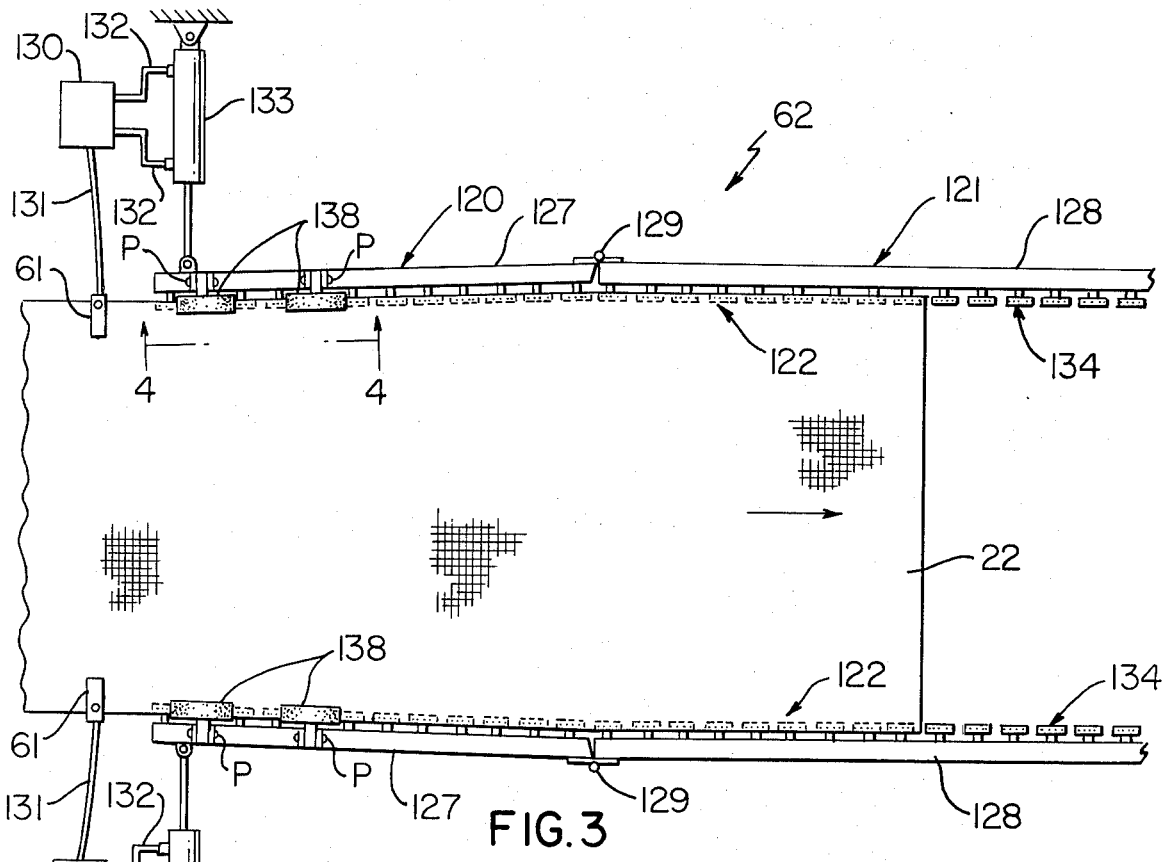
FIG. 3 is a plan view of certain key components of a tenter assembly or apparatus comprising the apparatus of FIGS. 1A and 1B showing an upstream swing section portion and a constant width downstream portion and illustrating a pair of endless chain drive mechanisms comprising the tenter assembly together with a wear layer of a carpeting strip being introduced thereon.

Reference is now made to FIG. 3 of the drawing which illustrates the forward portion of the tenter assembly 62 and such tenter assembly comprises an upstream so-called swing section 120 and a downstream constant width section 121. The tenter assembly 62 has a pair of endless chain drive mechanisms on opposite sides thereof and each is designated generally by the same reference numeral 122. Each chain drive mechanism 122 is comprised of a plurality of chain links each designated by the same reference numeral 123 (FIG. 5) which are interconnected by pins 124 as is known in the art to define endless chains 125. Each chain drive mechanism 122 also has a plurality of sprockets 126 (FIG. 4) which are suitably disposed and supported along the tenter assembly 62 to assure precision movement of the endless chains 125 and wear layer 22 with its backing material and tape applied thereon through the swing section 120 and constant width section 121 of the tenter assembly, through the precoat drying station 64, taping station 66, foam latex applying station 80, drying and curing station 87 while making a plurality of passes through the oven 88 at station 87, and trimming station 90. Once the completed carpeting strip exits the trimming station it is moved by other components of the moving means of apparatus 50 into and through the windup station 110.

The swing section 120 of the tenter assembly comprises a pair of horizontally movable chain support members 127 each of which is hingedly fastened to an associated fixed chain support member 128 of the constant width section 121 employing a suitable hinge 129. As previously mentioned, a pair of photoelectric detector devices 61 are provided to sense opposite edges of the wear layer (FIG. 3) and each device 61 provides appropriate signals to a control and energizing apparatus 130 through a cable 131. Each apparatus 130 is connected by lines 132 to an associated actuator 133, which may be in the form of an air cylinder, whereby depending on the signals from the devices 61 the actuators 133 move the support members 127 of the swing section 120 to assure that the wear layer 22 is introduced into the tenter assembly 62 for precision attachment thereof to the chains 125 as will be described in more detail subsequently.

Each device 61 and apparatus 130 is provided with electrical power from a suitable source as well as suitable power means for movement of the actuators 133 in the desired manner. It will also be appreciated that both apparatus 130 may be suitably synchronized and include control means to provide movement of the actuators 133 in opposite directions.

Figure 5:
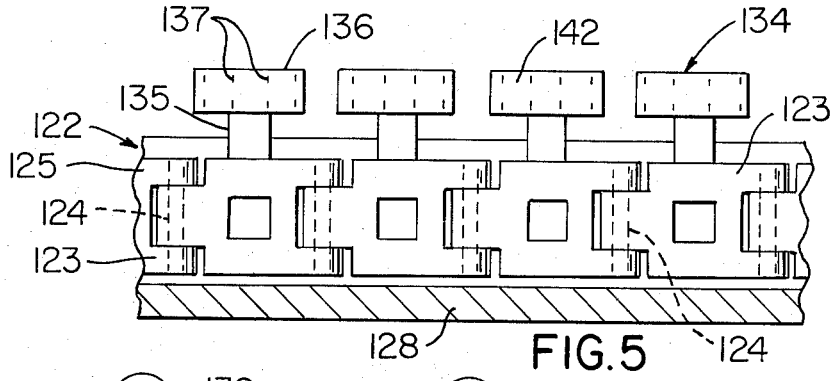
FIG. 5 is an enlarged fragmentary plan view looking perpendicularly toward a plurality of interconnected chain links comprising each chain drive mechanism of the tenter apparatus.

As seen in FIG. 5, each chain link 123 comprising each endless chain 125 has a roughly T-shaped member 134 extending therefrom with each T-shaped member having a leg 135 suitably fixed to its associated link 123 and a cross arm 136 portion suitably fixed to a leg 135 and such cross arm portion is popularly referred to in the art as a pin plate 136. Each pin plate 136 has a plurality of so-called tenter pins 137 suitably fixed thereto and extending therefrom and the tenter pins are in the form of needle-like pins of a type known in the art and are particularly adapted to be urged through the wear layer 22 to enable stretching of such wear layer 22 to a predetermined width and maintaining of such wear layer at such width while moving thereof by the moving means including the chain drive mechanisms 122.

The apparatus 50 comprises means for urging the tenter pins through the wear layer and such urging means comprises pairs of rotary devices each designated by the same reference numeral 138. Each rotary urging device of this example is shown as a rotary wire brush 138 having a weighted central portion and a shaft, pivotally supported on a pivot pin P attached to brackets which are in turn fixed to an associated member 127. Each device 138 has radially extending wire members 141 which are adapted to yieldingly engage the wear layer 22 and urge same toward pin plates 136 of its associated endless chain 125 thereby forcing the tenter pins 137 through the wear layer 22. The weight of the brushes is sufficient to urge the tenter pins through the fabric and as the fabric moves it rotates such brushes 138.

If desired, each brush 138 may be optionally driven by a motor 139 through mechanical connection 140 with each motor 139 and connection 140 carried by an associated support member 127. In the case of a motor driven brush the speed thereof is controlled to correspond to the lineal speed of the wear layer 22. Each device 138 whether weighted or motor driven urges the wear layer 22 snugly against the planar supporting surface 142 of each pin plate 136 so that the tenter pins extend through the wear layer 22 and are in position to provide the desired stretching of the wear layer 22 and movement thereof with movement of the endless chains 125.

The constant width section 121 of the tenter assembly 62 begins with hinges 129 and is illustrated at 63 in FIG. 1A. The constant width section extends from location 63 through the curing and drying station 87 which terminates at the outlet of the oven 88 comprising such station. Various operations are performed to define carpeting strip 20 while the wear layer is in a stretched constant width condition as will be described subsequently.

Figure 6:
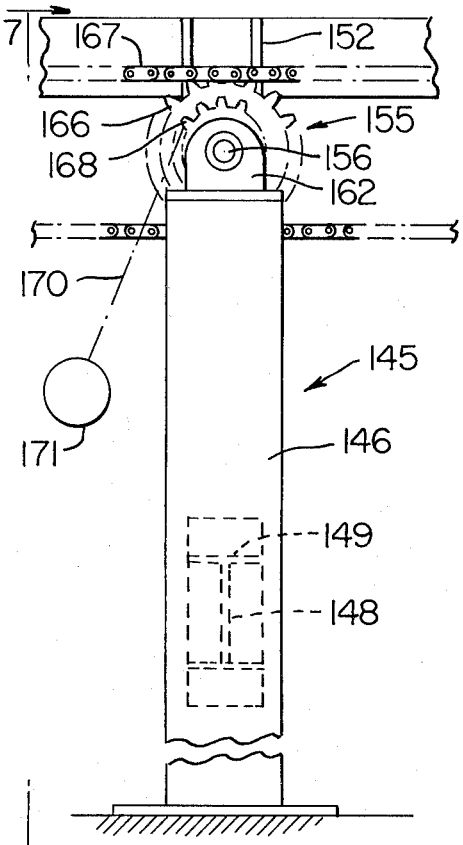
FIG. 6 is a view with parts in elevation and parts broken away illustrating a typical one of a plurality of support frames comprising the constant width section of the tenter assembly.
Figure 7:
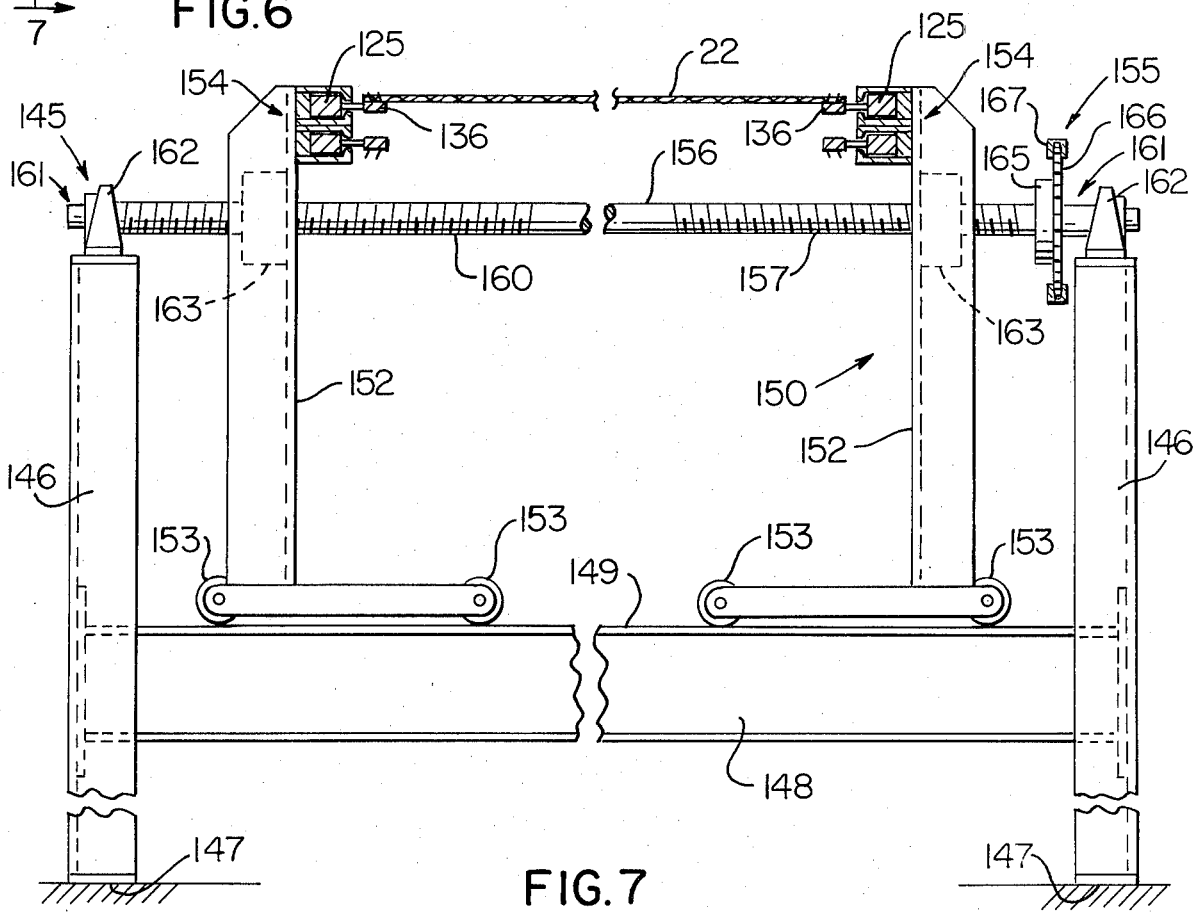
FIG. 7 is a view taken essentially on the line 7—7 of FIG. 6.

The constant width section 121 comprises a plurality of support frames disposed in suitably spaced relation along the apparatus 50 and a typical one of such support frames is shown in FIGS. 6–7 and designated generally by the reference numeral 145. Each support frame is comprised of a pair of vertical columns 146 which are fixed to a supporting floor as shown at 147 and on opposite sides of the apparatus 50. Each support frame 145 has a horizontal support beam 148 extending between its columns 146 and each support beam is a wide flanged I-beam having a top horizontally disposed planar surface 149 which serves as a track or way for a purpose now to be described.

The apparatus 50 comprises means for adjusting the horizontal positions of the chain drive mechanisms and such adjusting means is designated generally by the reference numeral 150. The adjusting means 150 comprises a pair of carriages associated with each frame 145 and each carriage is designated by the same general reference numeral 152 and has a plurality of wheels 153 supporting same for movement along the horizontal surface 149. Each carriage 152 supports an associated endless chain 125 of its chain drive mechanism as shown at 154.

The adjusting means 150 also comprises means 155 for moving the carriages 152 on all support frames 145 in a simultaneous manner and in particular along surface 149 of the I-beams 148 to thereby simultaneously move the pair of endless chains 125 either toward or away from each other and thereby adjust the width of the constant width section 121 of the tenter assembly 62.

The means 155 for moving the carriages 152 comprises a plurality of threaded rods 156 with each rod operatively associating with a pair of carriages 152 of a support frame 145. Each rod 156 has right hand male threads 157 on one end portion thereof and left hand male threads 160 on the opposite end portion thereof and the opposite terminal ends of each rod 156 are unthreaded or free of threads as shown at 161 and each is suitably rotatably supported in an anti-friction bearing assembly 162 which is fixed to an associated column 146.

Each carriage 152 has a threaded nut-like or nut member 163 detachably fixed thereto and each nut member 163 has female threads engaging an associated male threaded portion of rod 156. In particular, the member 163 engaging portion 157 has cooperating right hand threads thereon and the nut member 163 engaging the threaded portion 160 has cooperating left hand threads thereon. Thus, upon rotating each rod 156, as will be described subsequently, in one direction its associated carriages 152 move toward each other and upon rotating the rod 156 in an opposite direction its carriages 152 move away from each other whereby a simple rotary movement of each rod 156 provides simultaneous movement of its carriages 152 either toward or away from each other.

The means 155 for moving the carriages 152 in a simultaneous manner comprises a rotary disc member or disc 165 suitably fixed to one end portion of an associated rod 156 and each disc 165 has a sprocket 166 fixed thereto. Each sprocket 166 is operatively engaged by a sprocket chain 167 of conventional construction and the sprocket chain 167 is constructed and arranged so that it engages corresponding sprockets 166 of each of the rods carried on the plurality of support frames 145 and movement of the sprocket chain 167 causes simultaneous rotation of all lead screws 156 and simultaneous movement of all carriages 152 comprising the apparatus 50.

The sprocket chain 167 may be driven by any suitable means known in the art and in this example of the invention such sprocket chain is driven by a driving one of the sprockets 166 which has the chain 167 operatively engaging same. Accordingly, as shown in FIG. 6, a sprocket 168 is fixed on a typical rod 156 concentrically with a sprocket 166. The sprocket 168 is operatively connected by a chain which is shown schematically by a dot-dash line 170, to a reversible motor 171 which is preferably a reversible electric motor 171. Thus, it is seen that by simple rotation of the reversible electric motor 171 the entire width of the constant width section 121 of the tenter assembly 62 is either increased or decreased depending on the direction of rotation of the motor 171. Accordingly, once it is determined what the size of a carpeting strip 20 is to be, the constant width section of the tenter assembly is easily adjusted.

From the above description it is apparent that the tenter assembly 62 has means for stretching and holding the wear layer 22 at a precise width as described to enable fixing of the release tape 30 at precise locations thereagainst. The detailed description will now proceed with a description of the release tape applying device and method at the tape-applying or taping station 66.

THE TAPING STATION

In this example of the apparatus and method 50 of the invention the carpeting strip 20 is provided with release tape 30 along both side edge portions thereof at taping station 66; however, it is to be understood that such carpeting strip may be provided with release tape 30 along only one side edge portion thereof. Nevertheless, the detailed description will now proceed with a detailed description of a typical apparatus or device and method which is designated generally by the reference numeral 175 and is disposed along one side portion of the apparatus 50 at taping station 66 with it being understood that the description is fully applicable to both devices 175. A more detailed description of the apparatus and method 175 is presented in U.S. Patent Application Ser. No. 28,786, filed Apr. 10, 1979, now abandoned, the disclosure of which is incorporated herein by reference thereto. However, a sufficient description is presented in this disclosure for an understanding of the apparatus and method 175.

Figures 9, 10:
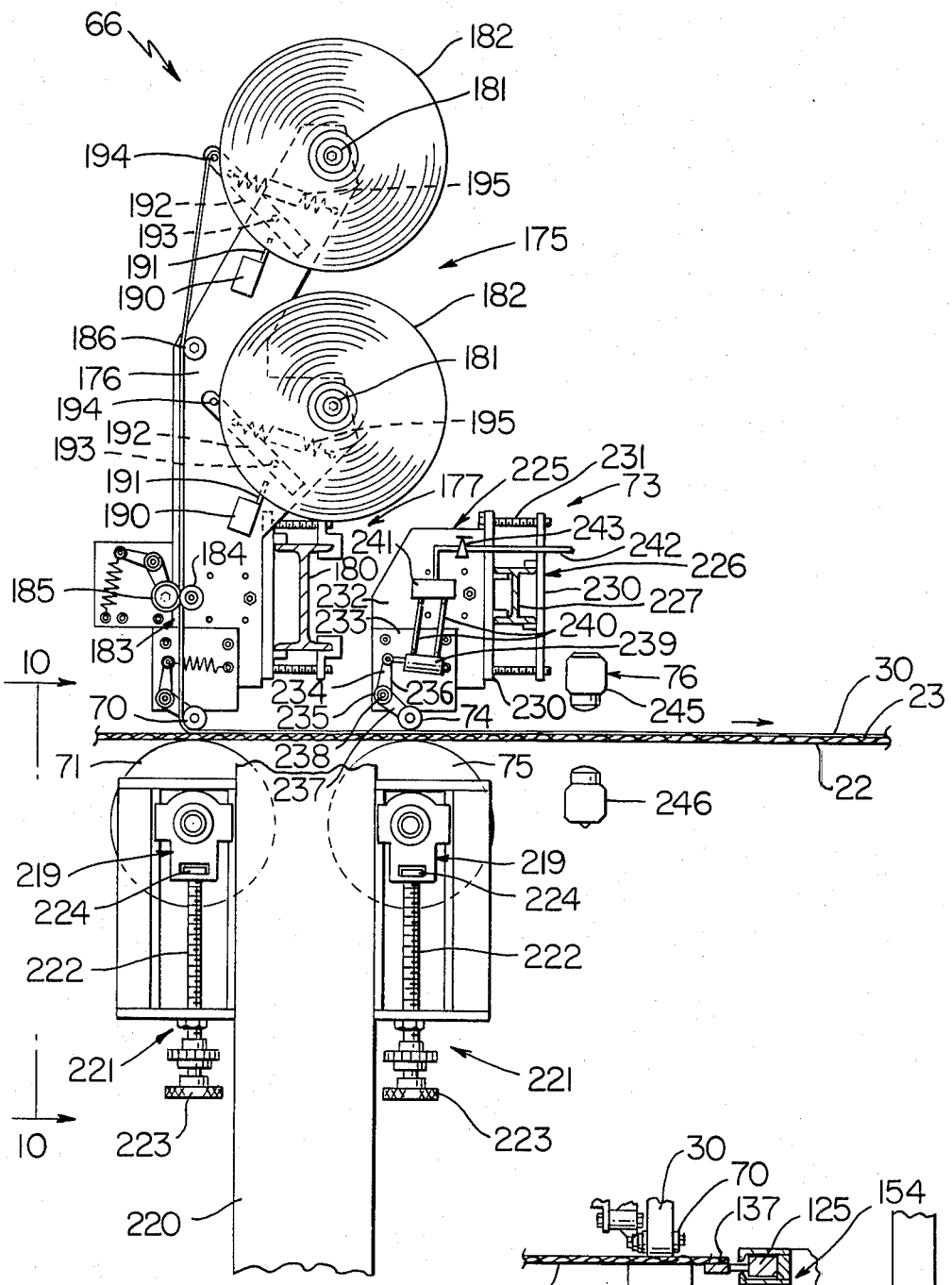
FIG. 9 is a view illustrating a device at a tape applying station of the apparatus and method of FIGS. 1A and 1B for applying release tape and also illustrating a tape bonding apparatus at a tape bonding station downstream thereof.
FIG. 10 is a view taken essentially on the line 10—10 of FIG. 9.

As seen in FIG. 9, the apparatus or device 175 comprises a support in the form of a support plate 176 which has a bracket assembly 177 suitably fixed thereto. The bracket assembly 177 is detachably fastened to a support beam shown as an I-beam 180 which extends across the entire width of the apparatus 50 above the wear layer 22.

The device 175 has adjustment means including a horizontal adjustment mechanism for providing horizontal adjustment of the plate 176 and hence the overall device 175 across the wear layer 22 between the tenter pins 137 of the tenter assembly 62 and a vertical adjustment mechanism. The adjustment mechanisms are described in more detail subsequently.

As seen in FIG. 9, the device 175 comprises a pair of support shafts each designated by the same reference numeral 181 which are carried by the support plate 176 and each shaft 181 supports an associated roll of release tape 30 with each overall roll being designated by the reference numeral 182. The device 175 also has means for attaching a leading end portion of tape from a new tape roll to a trailing end portion of tape from a depleted tape roll to thereby enable continuous production of the carpeting strip 20 free of any interruptions of the type that would be required to change a depleted tape roll and such means is designated generally by the reference numeral 187.

The release tape 30 has one surface thereof provided with a meltable adhesive 25 as previously mentioned and such adhesive is disposed against the inside surface 23 of the wear layer 22 after melting thereof by the hot air blower or heater 72 (FIG. 1A) which has a hot air discharge nozzle. The heater activates the meltable adhesive material 25 on the release tape 30 so that it will adhere to the inside surface of the wear layer 22 once it is urged thereagainst by the tape-applying roller 70 of device 175.

The device 175 also has a pair of cooperating compressing rollers which, in essence, serve to splice a leading end portion of tape 30 from a new tape roll 182 to the trailing end portion of tape 30 from a depleted roll 182 and such compressing rollers comprise the attaching means 183. The compressing rollers consist of one roller 184 which is rotatably supported in a fixed position and a roller 185 which is movable and yieldingly urged toward the roller 184.

During application of tape 30 against wear layer 22, the heating device 72 serves to melt the adhesive 25 provided on the release tape 30 so that such adhesive 25 is in a tacky condition and will adhere to the wear layer 22.

The device 175 has an idler roller 186 suitably rotatably supported along one side edge of the plate 176 and the roller 186 serves to direct release tape 30 vertically between the rollers 184 and 185. The idler roller 186 assures that release tape 30 from the upper tape supply roll 182 will be directed vertically between rollers 184 and 185.

The apparatus 175 also comprises means for detecting near depletion of tape from a used or nearly depleted tape roll 182 and such detecting means will be described with reference to FIGS. 9 and 12 and designated generally by the reference numeral 187 in FIG. 12. The detecting means comprises a pair of electrical limit switches 190, each attached to the plate 176 and each switch 190 has an actuating member 191. The detecting means also comprises a pair of arms 192 each pivotally supported by an associated portion of plate 176 by a pivot pin 193. Each arm 192 has an outer combination tape support and supply roll engaging roller 194 suitably rotatably supported at its outer end. A compression spring 195 is attached to each arm 192 at one end and to the plate 176 at its opposite end so that each roller 194 is yieldingly urged against the outermost turn of its supply roll 182 and as the tape 30 moves around the roller 194.

Figure 12:
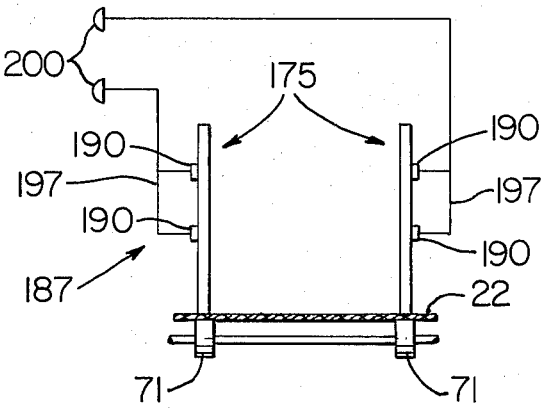
FIG. 12 is a schematic presentation showing portions of indicating means for indicating that each tape roll of the pair of tape rolls comprising each device of FIG. 9 and disposed on each side of the apparatus of FIGS. 1A and 1B is in a depleted condition.

The detecting means also comprises a suitable electrical system supplied with power from any suitable source (not shown) and includes an electrical cable assembly 197 associated with each device 175, FIG. 12. Each cable assembly 197 has signalling or indicating means 200 which may be in the form of an indicating light, sound alarm, or some other signalling means.

The operation of the detection means 187 will now be described in connection with FIGS. 9 and 12. Accordingly, when tape 30 from a nearly depleted roll 182, such as the upper roll 182 in FIG. 9 of the drawings, reaches a position such that its spring 195 urges the arm 192 against the actuating member 191 of its limit switch 190 a signal is provided by the signalling means 187. At this point an operator unwinds the leading end portion of tape 30 from a new tape roll shown as a lower tape roll 182 in FIG. 9 and introduces it between the compressing rollers 184 and 185 so that the terminal end of such leading end portion extends at least beyond the location that rollers 184 and 185 would be in contact if tape were not interposed. During this time it will be appreciated that adhesive material 25 on the leading end portion of the release tape 30 of the new tape roll 182 is adhered against the trailing end portion of tape 30 from the nearly depleted upper roll 182 whereby, in essence, such leading end portion is spliced to the trailing end portion. The operator allows both tapes to run together for a comparatively short distance defining a double-thickness of release tape until a length of the double-thickness tape extends beyond the roller 70 and is adhered to the wear layer 22 at which time the operator cuts the release tape 30 from the upper nearly depleted roll 182 and allows the taping action to continue employing release tape 30 from the lower or new tape roll 182.

During the time interval that the double thickness of tape is being employed adhesive material 25 on the release tape on the upper nearly depleted roll is urged against the inside surface of the wear layer 22 and once the release tape from the upper roll is cut away ending the double thickness section, adhesive from the newly installed lower roll 182 is the only tape in use. At this point a new tape roll is installed in the upper position and upon depletion of the lower tape roll 182 the limit switch 190 associated therewith is actuated thereby energizing its signalling means 200 enabling an operator to repeat the splicing action by introducing a leading end portion of release tape 30 from the upper roll which is now the new roll against the trailing end portion of tape 30 from the lower roll 182 and the above described operation repeated.

Figure 11:
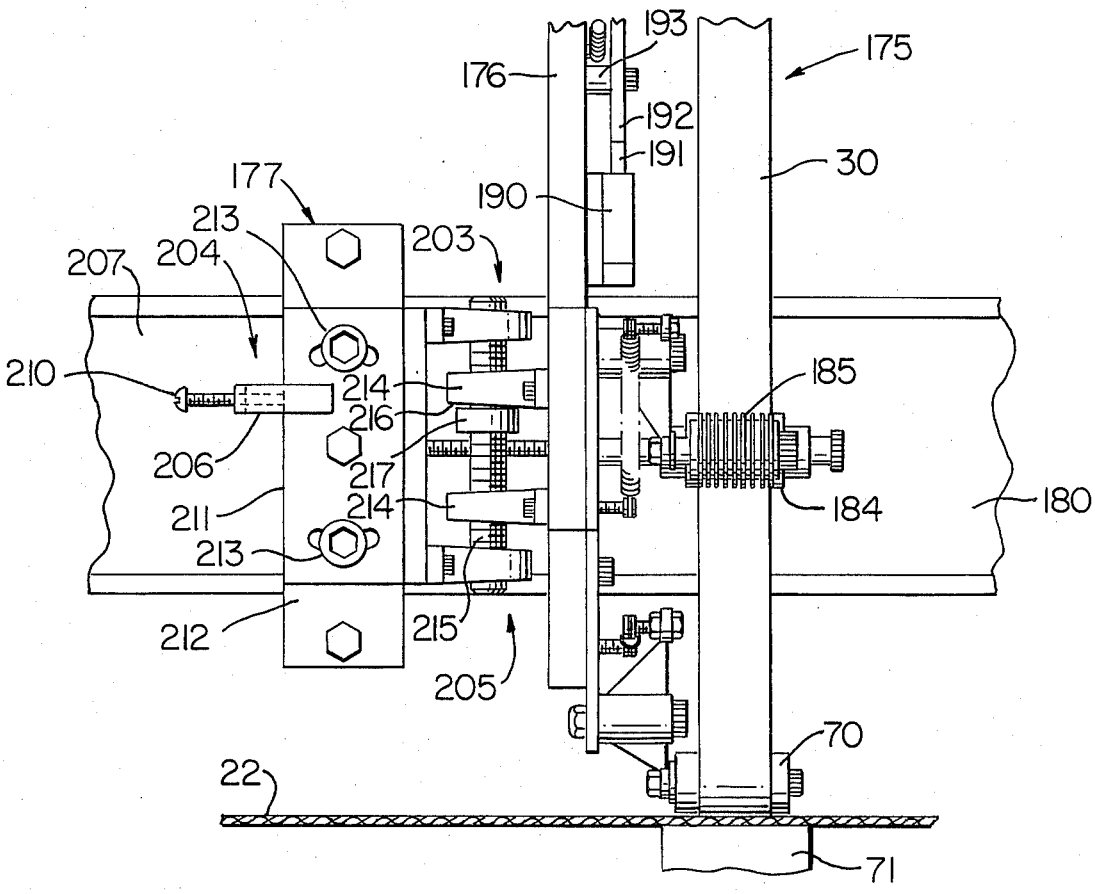
FIG. 11 is an enlarged fragmentary view particularly illustrating a horizontal and a vertical adjustment mechanism comprising the tape applying device of FIG. 9.

As previously mentioned the apparatus and method 175 has adjustment means (FIG. 11) designated generally by the reference numeral 203 and such adjustment means includes a horizontal adjustment mechanism 204 and a vertical adjustment mechanism 205. The mechanism 204 provides horizontal adjustment of the plate 176 and hence the overall device 175 across the wear layer 22 between the tenter pins of the tenter assembly 62 and a vertical adjustment mechanism 205 provides vertical adjustment toward and away from the horizontally moving wear layer 22.

The horizontal adjustment mechanism 204 includes a threaded housing member 206 which is fixed to a plate structure 207 carried by the bracket assembly 177 and a threaded set screw 210 which is adapted to be threadedly received within the member 206 for engagement of a side edge 211 of a structure 212 which is attached to the plate 176 whereby threading the screw 210 within member 206 in one direction pushes the structure 212 horizontally in a corresponding direction and threading the screw 210 in an opposite direction allows the side edge 212 of structure 212 and hence the overall device 175 to be moved in an opposite direction and kept against the terminal end of the screw 210. Once the structure 212 and device 175 is moved horizontally into the desired position a pair of threaded set screws 213 are employed for fixing same in position.

The vertical adjustment mechanism 205 includes a pair of vertically disposed spaced lugs 214 which are fixed to the plate 176; and, the lugs 214 have openings which receive therethrough a support rod 215 which may have a threaded central portion and is fixed to the bracket assembly 177. The upper one of such lugs 214 has a bottom surface 216 which is adapted to rest on a threaded collar 217 which is suitably threadedly adjusted on rod 215. The vertical position of the plate 176 and hence the overall device 175 is controlled by vertical threaded adjustment of the collar 217 and fixing of such collar in any desired position by a set screw, or the like.

The vertical adjustment mechanism 205 assures that the tape applying roller 70 of the device 175 is at the desired position for a particular thickness wear layer 22 and release tape 30. Similarly, the horizontal adjustment mechanism 204 assures that the tape applying roller 70 is disposed at the desired position across the width of the wear layer 22.

At the taping station 66 each device 175 also has a backup roll 71 (FIG. 9) associated with the tape applying roller 70 as previously mentioned. Each backup roll 71 may be of any suitable type known in the art and is preferably rotatably supported by an anti-friction bearing assembly 219 suitably supported on a support 220. The assembly 219 has an adjustment device which is designated generally by the reference numeral 221 which includes a threaded screw 222 provided with a knurled knob 223. The screw 222 has a suitable terminal end 224 which operatively associates with the bearing assembly 219 so that rotating knob 223 and screw 222 in one direction moves the backup roll toward the roller 70 and rotating the knob 223 in an opposite direction moves the backup roll 71 away from the roller 70. Thus, it is seen that the backup roll 71 is vertically adjustable to control the distance between the tape applying roller 70 and the backup roll 71. It will be appreciated that the backup roll 71 is adjusted together with device 175 to provide a precise gap between the rolls 70 and 71 to thereby take into account all types and thicknesses of tape 30 and wear layer 22.

THE TAPE BONDING STATION

The wear layer 22 with tape applied thereon is then continued to a tape bonding station 73 where a pair of tape bonding apparatus 225 is employed on opposite sides of the apparatus 50 and each associating with a tape 30. Each apparatus has a pressure roller 74 employed in cooperation with a backup roller 75 as previously mentioned and the detailed description will now proceed with a description of one apparatus 225 which is fully applicable to both.

The bonding apparatus 225 provided at the bonding station 73 has a bracket assembly 226 which supports same on a transverse beam in the form of an I-beam 227 which extends across the width of the wear layer 22 and across the apparatus 50. The bracket assembly includes a pair of plates each designated by the same reference numeral 230 which are detachably fastened in position by threaded screws 231 and in clamping engagement around the I-beam 227.

The bonding apparatus 225 also includes a support 232 having a plate portion or plate 233 suitably fixed thereto. The plate 233 has an L-shaped lever 234 which has a bight 235 and a pair of arms 236 and 237 extending from the bight. The lever 234 is pivotally supported at its bight on the plate 233 by a pin 238. The bonding roller or pressure roller 74 is rotatably supported on a suitable shaft at the end of the arm 237.

The bonding apparatus 225 has means for applying a controlled pressure against its release tape 30 by urging the pressure roller 74 in a controlled manner against such release tape 30 and wear layer 22 while it is being backed up by its backup roller 75. The means for applying a controlled pressure with pressure roller 74 comprises an actuating mechanism in the form of an air cylinder 239. The air cylinder 239 is supplied with air pressure through either one of two lines 240 from a control device 241 which is supplied with air under pressure through a conduit 242 which has an adjustable air pressure regulator 243 installed therein. Air from a suitable pressure source is provided into conduit 242 upstream of the air pressure regulator 243.

The means for applying a controlled pressure includes the L-shaped lever 234 and associated components; and, the cylinder 239 has one end portion pivotally connected to arm 236 and its opposite end portion pivotally connected to plate 233. Thus, upon actuating the cylinder 239 the lever 234 is pivoted about its pivot pin or shaft 238 to provide pivoting movement of such lever and provide movement of the pressure roller 74 so that it exerts a predetermined and precisely controlled bonding pressure against the release tape while it is backed up by its backup roller 75.

The controlled pressure exerted by roller 74 is made possible by adjusting the adjustable air pressure regulator 243 whereby the air pressure exiting therefrom to the control device 241 is within a desired range. In addition, because of the use of an air cylinder 239, the pressure is yieldable. Also the control device has suitable conventional means enabling the cylinder 239 to extend or retract its moving rod end and thereby pivot roller 74 into pressure engagement with tape 30 or away therefrom. It will be appreciated that the regulator 243 is also adjusted taking into account the type of adhesive 25, character of the wear layer 22, and thickness of tape 30 and wear layer 22.

The tape bonding station 73 has a pair of backup rolls 75 each associated with a pressure roller 74 as previously mentioned. Each backup roll 75 may be similar to the backup roll 71 and is preferably similarly rotatably supported by components designated by the same reference numerals as similar components of roll 71. In particular, roll 75 is supported by an anti-friction bearing assembly 219 suitably also supported on support 220. The assembly 219 also has an adjustment device 221 which includes a threaded screw 222 provided with a knurled knob 223. The screw 222 has a terminal end 224 which operatively associates with the bearing assembly 219 so that rotating knob 223 and screw 222 in one direction moves the backup roll 75 toward the roller 74 and rotating the knob 223 in an opposite direction moves the backup roll 75 away from the roller 74. Thus, it is seen that the backup roll 75 is vertically adjustable to control the nip or the distance between the tape applying roller 74 and the backup roll 75. Adjustment of the backup roll 75 together with its apparatus 225 enables provision of a precise gap between the rolls 74 and 75 to thereby take into accound all types and thicknesses of tape 30 and wear layer 22.

THE UNCOVERED RELEASE TAPE DETECTION STATION

The apparatus and method 50 employ a pair of photoelectric devices 76 at the uncovered release tape detection station, FIG. 9. As previously mentioned each device 76 comprises a light emitting unit 245 which cooperates with a receiving unit 246 and associated circuitry (not shown) and detects the presence of release tape 30 as it moves past such device. In the event tape 30 is not present on the wear layer 22 a suitable alarm or signal (not shown) is provided, as mentioned earlier, to indicate the absence of release tape and thereby allow the operator of the apparatus 50 to take necessary corrective action.

THE FOAM APPLYING STATION

Figure 8:
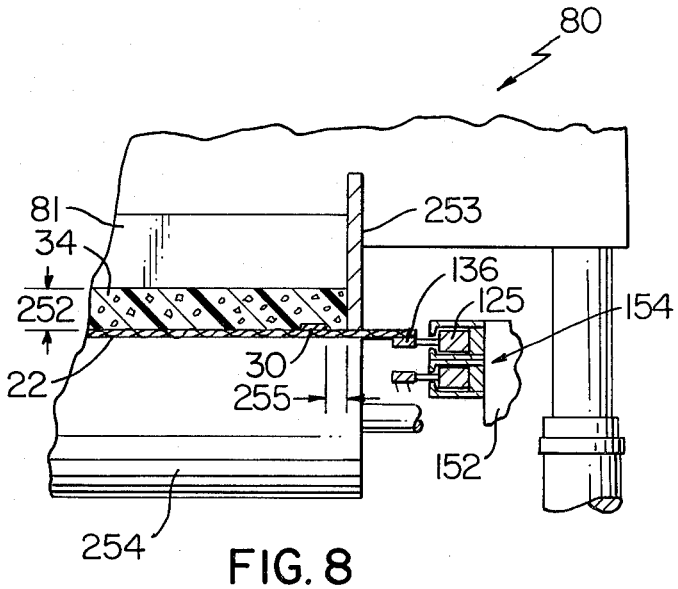
FIG. 8 is a fragmentary view with parts in cross-section, parts in elevation, and parts broken away illustrating components at a foam applying station of the apparatus and method of FIGS. 1A and 1B employed in applying material defining the compressible resilient foam backing material of the carpeting strip of FIG. 2.

The wear layer 22 with release tape 30 applied and bonded to its opposite side portions is then introduced through the foam applying station 80 as shown in FIG. 8. At station 80 a suitable thickness of latex foam is applied and when cured and dried such foam defines a sponge-like rubber or latex foam rubber. The foam backing material, even though in an uncured condition, will be designated by the same reference numeral 34 in FIG. 8 as in its completed form in FIG. 2.

The backing material defining latex foam 34 is preferably controlled in its vertical thickness employing a doctor blade 81, the position of which above the wear layer 22 is precisely controlled to define a controlled thickness 252 of the backing layer 34. A pair of edge dams or vertical plates 253 are provided on opposite sides and confine the foam material 34. A suitable backup roll 254 is provided and supports the wear layer 22 with the release tape 30 applied thereagainst as two ribbons on opposite side portions thereof. As indicated earlier the foam 34 is applied using nozzle 82 and moving means 83 therefor as shown in FIG. 1A.

The foam 34 is applied at station 80 so that it extends beyond the tape 30 on each side by a typical distance 255 which is defined by positioning of plates 253. This assures that once the carpet construction is trimmed at the trimming station 90 release tape defines opposite side edges of the carpeting strip 20.

THE FOAM GELLING STATION

The latex foam material 34 introduced at station 80 is gelled on wear layer 22 at a foam gelling station 84 as previously mentioned employing a lamp assembly 85, FIG. 1B. The lamp assembly 85 cooperates with the wear layer 22 as stretched by the constant width section 121 of the tenter assembly 62 and knife over roller coater at station 80 to provide precision control of the foam height before drying and curing thereof.

THE DRYING AND CURING STATION

The carpet construction with the foam gelled on the wear layer 22 and the tapes 30 concealed or sandwiched between wear layer and foam is then cured at the drying and curing station 87, FIG. 1B. As indicated earlier oven 88 is used at station 87 and such oven is controlled in temperature as determined by the foam latex being cured to define the cured latex backing material 34.

THE TRIMMING STATION

Figure 14:
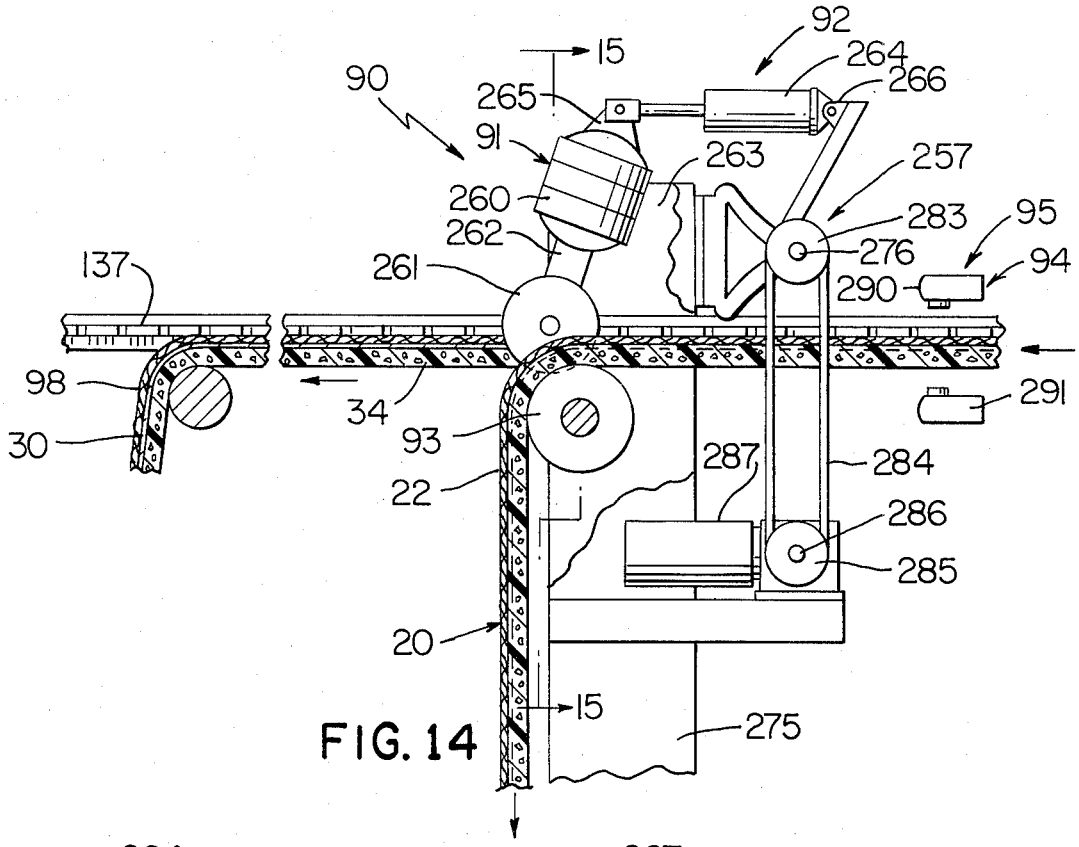
FIG. 14 is a view of apparatus provided at the trimming station.
Figure 15:
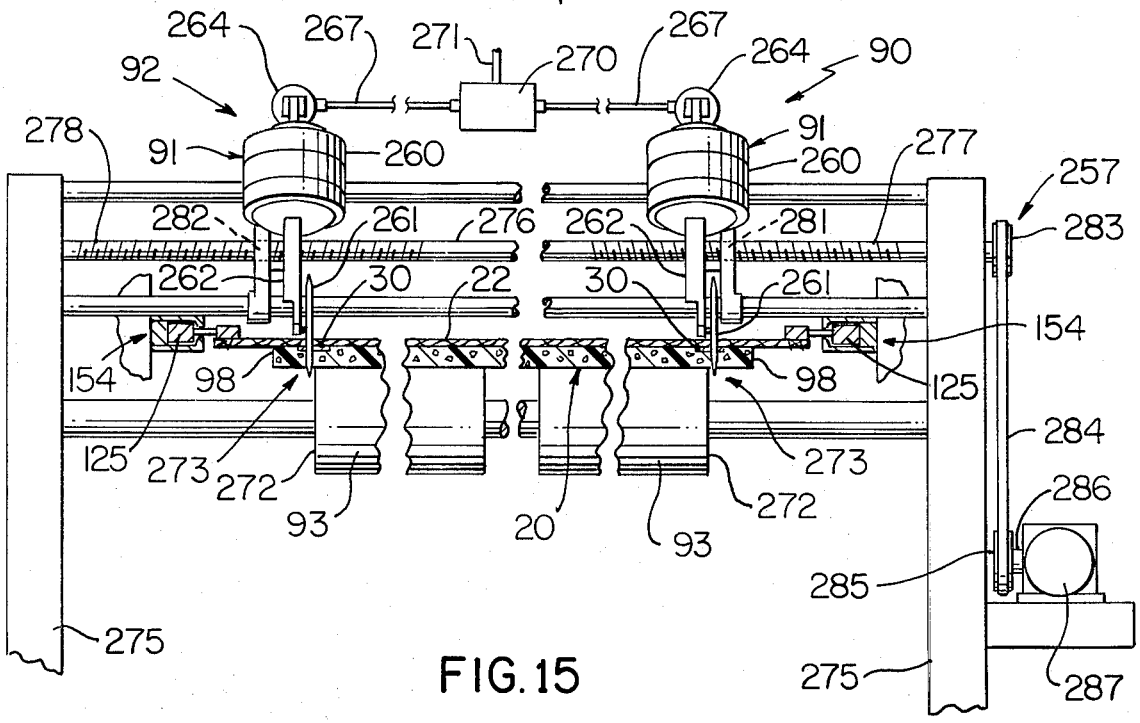
FIG. 15 is a view taken essentially on the line 15—15 of FIG. 14.

As previously mentioned, the dried and cured carpeting strip 20 with tape 30 along its opposite side portions is introduced into a carpeting strip trimming station 90 (FIGS. 14–15) immediately after inspection for the presence of concealed release tape 30. At station 90 trimming apparatus 92 is used to cut the carpeting construction and define the carpeting strip 20 and a pair of trimmed strips or ribbons of scrap material on opposite sides thereof which are removed from the apparatus 50.

Figure 13:
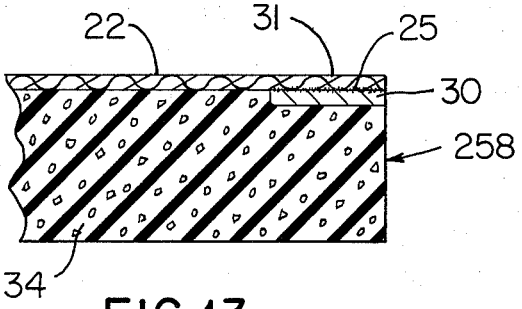
FIG. 13 is an enlarged fragmentary cross-sectional view, not drawn to scale, and showing a trimmed cut side edge of the carpeting strip as trimmed by a cutter.

The trimming apparatus 92 has cutting means in the form of a pair of rotary cutters 91 each of which is employed for cutting through the wear layer 22, tape 30, and backing material 34. The apparatus 92 also has means 257 for positioning each cutter 91 to define the width of the carpeting strip with precision while assuring a predetermined width of release tape 30 remains on the carpeting strip 20 after cutting by the cutters 91 while providing a precision planar cut side edge on each side edge of such carpeting strip designated generally by the reference numeral 258 and as shown in FIG. 13. The precision planar cut side edge 258 is defined by an edge of the wear layer 22, release tape 30, and backing material 34. Thus, the carpeting strip 20 is particularly adapted to have such a precision cut side edge thereof disposed in abutting relation against a substantially identical carpeting strip having a substantially identical cut side edge while removing the tape 30 from the carpeting strip and a similar tape from the identical carpeting strip and bonding the free parts 31 of the wear layer (as previously described in connection with FIG. 2) together against support means 43 bridging an isolated portion of backing material of the carpeting strip and a similar isolated portion of backing material of the identical carpeting strip to thereby define a substantially invisible joint therebetween.

Each rotary cutter 91 comprises an electric motor assembly 260 which drives a rotary blade 261 through a mechanical connection 262. Each motor assembly 260 is pivotally supported on a support structure 263 and the pivoting of the assembly 260 is provided by an actuator in the form of an air cylinder 264. Each cylinder 264 has its telescoping rod end pivotally connected to a lug 265 on the cutter 91 and its opposite end pivotally connected on another lug 266 provided on the support structure 263. Each air cylinder 264 is provided with air under pressure through a conduit assembly 267 which is controlled by a control system 270 which is in turn supplied with air under pressure from a souce 271 whereby each cutter 91 and its blade 261 are moved into and out of cutting engagement.

The cutting apparatus 92 has a backup roller 93 operatively associated with each rotary cutting blade 261 of each cutter 91. Each roller 93 has a planar side edge 272 thereof disposed on one side of and closely adjacent its associated rotary cutting blade 261 as shown at 273 to thereby define a precision cut edge 258 (FIG. 13) at each side of the carpeting strip 20. Although in this example, the backup rollers 93 are disposed inwardly of their associated blades 261, toward the center of the apparatus, it will be appreciated that such rollers may be disposed outwardly of blades 261.

The trimming apparatus 92 has a pair of support columns 275 on opposite sides thereof and such columns are particularly adapted to support the positioning means 257 for positioning each cutter 91 and in particular each rotary cutting blade 261 independently of the tenter assembly 62. The positioning means 257 comprises a rod 276 which has right hand threads 277 at one end portion thereof and left hand threads 278 at its opposite end portion. The right hand cutter 91 (as viewed in FIG. 15) has a threaded member 281 provided with corresponding right hand threads and which is in threaded engagement with the threaded portion 277; and, the left hand cutter 91 has a threaded member 282 which is provided with left hand threads and is in threaded engagement with the threaded portion 278. The opposite ends of the rod 276 are suitably supported in anti-friction bearings provided in associated columns 275 so that the member 276 is disposed substantially horizontally above the carpet construction.

The means 257 for positioning cutters 91 also comprises a pulley 283 fixed to one end of the rod 276 and such pulley is driven by an endless driving member which may be in the form of an endless power transmission belt 284. The belt 284 is operatively connected to a pulley 285 which is fixed to a shaft 286 which is driven by a reversible electric motor 287. The positioning means 257 enable movement of the cutters 91 toward each other by rotating the motor 287 in one direction and movement of the cutters 91 away from each other by rotating the motor 287 in an opposite direction.

The trimming apparatus 92 is adjusted so that the tape 30 is cut by cutters 91 at the desired position at each side edge of the carpet construction to define cut edges 258. Further, the cutting action is controlled to provide a minimum width of release tape 30 (generally of the order of ¾ of an inch or more) at each side edge of carpeting strip 20 for the purpose of providing an invisible joint between adjoining carpeting strips 20 and in a manner previously described. To assure that each release tape 30 extends to its cut edge 258, a concealed release tape detection apparatus is provided at station 95, as will now be described.

CONCEALED RELEASE TAPE DETECTION STATION

Figure 4:
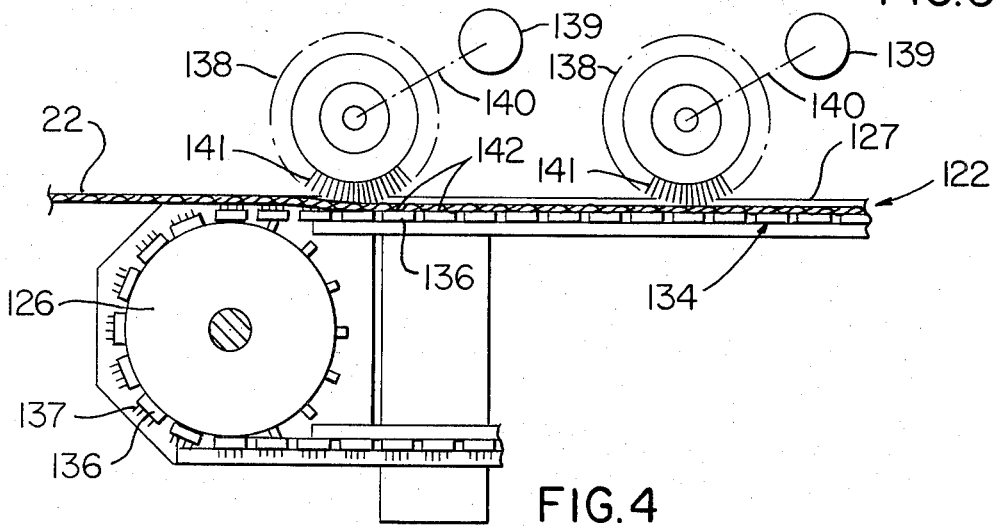
FIG. 4 is an enlarged view with parts in elevation, parts in cross-section, parts broken away, and parts shown schematically particularly illustrating urging means employed in urging tenter pins comprising the tenter apparatus through the wear layer.

As mentioned earlier, the apparatus 50 has a covered or concealed release tape detection station 95 immediately upstream of the trimming station 90, FIG. 4. At station 95 a pair of photoelectric devices 94 are employed and each photoelectric device 94 detects the presence of release tape 30, the width of such tape, and enables setting of its cutting device to define cut edge 258 which has the outer edge of tape 30 coplanar with and defined as a part of such cut edge 258. Each photoelectric device 94 includes a sending unit 290 and an associated receiving unit 291. Each device 94 also has signalling means (not shown) associated therewith for providing an appropriate signal in the event that the release tape 30 is either not present, is not in the required position, or is not of the required width. The signalling means provides an appropriate signal which enables the operator of the apparatus 50 to take corrective action including making the necessary adjustment of the trimming apparatus to cut the release tape as required as well as adjust the taping device 175 to place each tape in the required position. Each photoelectric device 94 also operatively associates with the previously mentioned marking mechanism 94 comprising the apparatus 50 as previously described.

THE TRIM REMOVAL STATION

As mentioned earlier, after trimming or cutting the carpeting strip 20 at the trimming station 90 a pair of scrap strips or ribbons 98 of trimmed material remain on the tenter pins 137. The ribbons 98 are conveyed to the trim removal station 100 which employs the trim removal apparatus 101 to pull the strips 98 from the tenter pins of the tenter assembly 62 for scrapping purposes.

The carpeting strip 20 continues from the trimming station 90 through the remaining stations of the apparatus and method as described earlier in general terms to the windup station 110.

In this disclosure of the invention sources of power including electrical power, fluid power such as air under pressure, and the like, for the various components have not been illustrated and described; however, it is to be understood that such power sources may be provided employing any suitable means known in the art. It will also be appreciated that the supports and mechanical drives for the overall moving means of the apparatus 50 and for various components of such apparatus have also not been illustrated and described herein and it is to be understood that any suitable means known in the art may be used to define such supports and drives.

While present exemplary embodiments of this invention and methods of practicing the same, have been illustrated and described, it will be recognized that this invention may be otherwise variously embodied and practiced within the scope of the following claims.

What is claimed is:

1. In an apparatus for continuously making a carpeting strip having integral joining means; said apparatus comprising means for feeding a wear layer having a bottom surface and opposed side edges; means for continuously moving and guiding said wear layer in a rectilinear path; photoelectric means for sensing a side edge of said wear layer to enable adjustment of a part of said moving means and thereby provide adjustment of the position of said wear layer; a device for fixing a release tape against said bottom surface adjacent an associated side edge portion of said wear layer; said release tape defining a free part of said wear layer disposed thereagainst; and means for forming a compressible backing material against said bottom surface and against said tape so that said tape isolates a portion of said backing material from said wear layer and is sandwiched therebetween; the improvement comprising; a tenter assembly defined as a part of said moving means with said tenter assembly having means for stretching and holding said wear layer at a precise width to enable fixing said release tape at a precise location thereagainst; adjustment means for said device to enable adjustment thereof relative to said wear layer and fixing of said tape at said precise location adjacent said side edge portion; a trimming apparatus having cutting means for cutting through said wear layer, tape, and backing material; means for positioning said cutting means to assure a predetermined required width of release tape remains on said carpeting strip after cutting by said cutting means while providing a precision planar cut side edge for said carpeting strip defined by an edge of said wear layer, release tape, and backing material disposed in coplanar relation; said positioning means being adapted to be operated independently of said tenter assembly; a photoelectric device disposed along a side edge portion of said carpeting strip; said photoelectric device detecting said release tape in its sandwiched position to assure presence of a required width thereof during continuous making of said carpeting strip and after cutting by said cutting means; and a carpeting strip marking mechanism operatively connected to said photoelectric device; said marking mechanism being actuated by said photoelectric device and providing continuous marking of said carpeting strip in response to detection of the required width of release tape by said photoelectric device; said marking mechanism ceasing its marking once said photoelectric device detects that said required width is no longer present; said carpeting strip being particularly adapted to have a cut side edge thereof disposed in abutting relation against a substantially identical carpeting strip having a substantially identical cut side edge by removing said tape from said carpeting strip and a similar tape from said identical carpeting strip and bonding the free parts of said wear layers together against support means bridging an isolated portion of backing material of said carpeting strip and a similar isolated portion of backing material of said identical carpeting strip.

2. In an apparatus for continuously making a carpeting strip having integral joining means; said apparatus comprising means for feeding a wear layer having a bottom surface and opposed side edges; means for continuously moving and guiding said wear layer in a rectilinear path; photoelectric means for sensing opposite side edges of said wear layer to enable adjustment of a part of said moving means and thereby provide adjustment of the position of said wear layer; a pair of devices for fixing a pair of release tapes against said bottom surface with each of said devices fixing its release tape adjacent an associated side edge portion of said wear layer; each release tape defining a free part of said wear layer disposed thereagainst; and means forming a compressible backing material against said bottom surface and against said tapes so that each of said tapes isolates a portion of said backing material from said wear layer and is sandwiched therebetween; the improvement comprising; a tenter assembly defined as a part of said moving means with said tenter assembly having means for stretching and holding said wear layer at a precise width to enable fixing each of said release tapes at a precise location thereagainst; adjustment means for each of said devices to enable adjustment thereof relative to said wear layer and fixing of an associated tape at said precise location adjacent an associated side edge portion; a trimming apparatus having a pair of cutting means for cutting through said wear layer, tapes, and backing material; and means for positioning each cutting means to define the width of said carpeting strip and assure a predetermined required width of release tape remains on each side edge portion of said carpeting strip after cutting by said cutting means while providing each of said side edge portions with a precision planar cut side edge defined by an edge of said wear layer, release tape, and backing material disposed in coplanar relation; said positioning means being adapted to be operated independently of said tenter assembly; a pair of photoelectric devices each disposed along a side edge portion of said carpeting strip; each of said devices detecting associated release tape in its sandwiched position to assure presence of a required width thereof during continuous making of said carpeting strip and after cutting by said cutting means; and a carpeting strip marking mechanism operatively connected to each of said photoelectric devices; said marking mechanism being actuated by either of said photoelectric devices and providing a continuous marking of said carpeting strip in response to detection of the required width of release tape by each photoelectric device; said marking mechanism ceasing its marking once a photoelectric device detects that said required width is no longer present; said carpeting strip being particularly adapted to have a cut side edge thereof disposed in abutting relation against a substantially identical carpeting strip having a substantially identical cut side edge by removing said tape from said carpeting strip and a similar tape from said identical carpeting strip and bonding said free parts of said wear layers together against support means briding an isolated portion of backing material of said carpeting strip and a similar isolated portion of backing material of said identical carpeting strip.

3. An apparatus as set forth in claim 2 in which each of said cutting means comprises an electric powered rotary cutting blade and said trimming apparatus comprises, a pair of backup rollers, and a support supporting each backup roller so that a planar side edge thereof is disposed on one side of and closely adjacent to its associated rotary cutting blade.

4. An apparatus as set forth in claim 3 in which said positioning means comprises a mechanical system for moving said cutting means independently of said tenter assembly.

5. An apparatus as set forth in claim 4 in which said mechanical system comprises means for moving said pair of cutting means in a simultaneous manner either toward or away from each other.

6. An apparatus as set forth in claim 4 and furthermore comprising a pair of tape bonding apparatus each bonding an associated release tape, each bonding apparatus comprising a pressure roller and a cooperating backup roller, each pressure roller and its backup roller assuring release tape passing therebetween is bonded to said wear layer in a high strength means.

7. An apparatus as set forth in claim 6 in which each bonding apparatus further comprises means for applying a controlled pressure against an associated release tape.

8. An apparatus as set forth in claim 7 in which said means for applying a controlled pressure comprises an air pressure actuated cylinder and control means therefor including an adjustable air pressure regulator valve for controlling the air pressure to said cylinder.

9. An apparatus as set forth in claim 8 in which said means for applying a controlled pressure comprises means for adjusting the position of said backup roller relative to said pressure roller to control the nip therebetween.

10. An apparatus as set forth in claim 6 in which each tape bonding apparatus comprises a support member, an L-shaped lever, said lever having a bight and a pair of arms extending away from said bight, said lever being pivotally supported by its bight on said support member, a shaft rotatably supporting said pressure roller at the terminal end of one of said arms, and air cylinder means operatively connected to the other of said arms and pivotally moving said lever and pressure roller so that said pressure roller applies a controlled pressure against said release tape.

11. An apparatus as set forth in claim 2 in which said tenter assembly comprises a pair of endless chain drive mechanisms each having a plurality of chain links, each of said chain links having a roughly T-shaped member extending therefrom with each T-shaped member having a leg fixed to an associated link of said chain and a crossarm fixed to said leg, each crossarm defining a pin plate having a plurality of tenter pins extending therefrom which are adapted to be urged through said wear layer of said carpeting strip to enable stretching said wear layer and movement thereof.

12. An apparatus as set forth in claim 11 in which said tenter assembly comprises a swing section for receiving said wear layer to enable stretching and movement thereof through said assembly and a constant width section downstream of said swing section.

13. An apparatus as set forth in claim 12 and further comprising means for urging said tenter pins through said wear layer.

14. An apparatus as set forth in claim 13 in which said urging means comprises a rotary urging device having a yieldable outer portion for engaging said wear layer and forcing said tenter pins therethrough during movement of said wear layer by said tenter apparatus.

15. An apparatus as set forth in claim 12 in which said constant width section of said tenter assembly comprises a plurality of support frames, a pair of carriages carried on each support frame with each carriage supporting an associated endless chain of its chain drive mechanism, and means for moving said carriages in a simultaneous manner on said support frames to thereby simultaneous move said pair of endless chains and control the width of said carpeting strip.

16. An apparatus as set forth in claim 15 in which said means for moving said carriages comprises a plurality of threaded rods each operatively associated with a pair of carriages and each rod having right hand threads along one end portion and left hand threads along the opposite end portion, a threaded nut member carried by each carriage and threadedly engaging an associated threaded portion, one of said nut members having right hand screw threads corresponding to its threaded portion and the other of said nut members having left hand screw threads corresponding to its threaded portion, and means for rotating said threaded rods in opposed directions of rotation, said rotating means providing simultaneous movement of each pair of carriages toward each other upon rotating said rods in one direction of rotation and providing simultaneous mvement of each pair of carriages away from each other upon rotating said rods in an opposite direction of rotation.

* * * * *